US005704855A

United States Patent [19]

Kellogg, Jr.

[11] Patent Number: 5,704,855

[45] Date of Patent: Jan. 6, 1998

[54] BASEBALL PITCHING PRACTICE APPARATUS

[76] Inventor: Jack V. Kellogg, Jr., 106 Van Buren Ave., Cuyahoga Falls, Ohio 44221

[21] Appl. No.: 740,087

[22] Filed: Oct. 24, 1996

[51] Int. Cl.[6] ..... A63B 69/40

[52] U.S. Cl. ..... 473/422

[58] Field of Search ..... 473/454, 455, 473/456

[56] References Cited

U.S. PATENT DOCUMENTS

| | | | |
|---|---|---|---|
| 4,204,677 | 5/1980 | Hagaarty | 473/454 |
| 4,295,648 | 10/1981 | Stromback | 473/456 |
| 5,348,291 | 9/1994 | Scully | 473/454 |
| 5,350,172 | 9/1994 | Garrett | 473/454 |

*Primary Examiner*—Theatrice Brown

[57] ABSTRACT

A general purpose portable pitching, throwing, or kicking device comprised of a singular one-piece supporting base with centrally located apertures for holding two spaced apart vertical parallel uprights affixed with two horizontal parallel cross members for framing a strike zone in space. The strike zone frame is fully adjustable in height, and adjustable in width from the supporting base and may be easily disassembled for transport and storage. The strike zone frame may also be adjusted to form a non-parallel shape if desired to emphasize pitching techniques. The invention is adaptable to baseball, soccer training, archery practice, lacrosse players, or the like by an appropriate choice of strike zone frame shape, size, and position.

3 Claims, 3 Drawing Sheets

BASEBALL PITCHING PRACTICE APPARATUS

BACKGROUND OF THE INVENTION

1. Field of the Invention

The invention pertains to the field of sports training equipment. More particularly, the invention pertains to training and practice equipment for perfecting pitching and throwing skills, and may be used to determine pitching and throwing proficiency, particularly applicable to the game of baseball. Although it is also useful in other games requiring accuracy in ball handling such as soccer or lacrosse.

2. Description of the Prior Art

Baseball is played on an area divided into an infield of standard proportions and an outfield of varied dimensions. The infield is square, with 90 ft. on each side. The corner farthest from the outfield fence is home plate, and the other bases -first, second, and third-run counter-clockwise. Home plate is white in color, 17 inches long, with the 17 inch edge facing the pitchers plate. The pitchers plate is a small rectangular rubber slab 24 inches by 6 inches with the 24 inch edge facing home plate at a distance of 60 ft. 6 in. The pitchers plate is located in the center of an 18 ft circle called the pitchers mound, which inclines upward.

The team at bat sends its nine players to the plate in a specified sequence. The pitcher delivers the ball, which is 2¾ inches in diameter, to the batter. Each batter attempts to hit the pitcher's deliveries, which the latter tries to vary in speed and placement within the strike zone (the area over home plate and between the batter's knees and armpits). If the ball is not struck at and any part of the ball passes through any part of the strike zone it is considered a strike. Throws which cross the plate outside the strike zone are not desirable, as they count as "balls" if the player does not swing at them.

It is thus important that the pitcher be able to throw the ball within the limits of the strike zone, while being able to vary speed and placement within those limits. This accuracy requires practice to attain, especially for young players, who must contend with the combination of lesser inherent coordination and a smaller strike zone. The pitcher can simply practice with a catcher, but then must envision an abstract strike zone for the hypothetical batter. In training a player to throw accurately, a coach will not only want him to practice throwing at specific target but to practice placing the ball within various sized and shaped strike zones.

The present invention is readily portable and may be conveniently set up over home plate, out in a grassy field, in a gymnasium, or elsewhere. Furthermore, the present invention provides a fully adjustable target configuration which may be adjusted in position, size, and shape (rectangular or non-parallel).

A number of pitching targets have been previously patented. These include the following.

Rovane, U.S. Pat. No. 1,592,005, shows a pitching practice guide comprising a pair of upright posts supporting a pair of cross-posts, which define a strike zone simulation. The cross-posts are not easily adjustable. The width of the strike zone is not adjustable. There is not a singular one-piece supporting base which defines home-plate of the strike zone at ground level.

Kleb, U.S. Pat. No. 1,879,316, shows a baseball strike zone target which is defined by colors on a number of ropes suspending an iron plate. A smaller ball target is also supplied, independent of the strike zone, adjustable in height by the pitcher by moving ropes extending out to the mound. A gutter returns balls which hit a flat canvas backstop. The strike zone and ball targets are not related, the strike zone is not adjustable, there is not a singular one-piece supporting base which defines home-plate of the strike zone at ground level.

Fowler, U.S. Pat. No. 2,126,102, shows a pitching target in front of a backstop cage. The strike zone is a rectangle subdivided by diagonals to define multiple areas. The size of the strike zone is not adjustable. There is not a singular one-piece supporting base which defines home-plate of the strike zone at ground level.

Ziel, U.S. Pat. No. 2,254,986, shows a target in the form of a suspended canvas sheet with a batter and catcher drawn on it. A hole in the center of the catcher's mitt forms a target, as well as four other for inside and outside high and low balls. The targets (being holes) are not adjustable in size or location, and there is no strike zone.

Respini, U.S. Pat. No. 3,195,898, shows a mesh back-stop with a target (circles) imprinted upon it. The target is not adjustable, there is no strike zone or a singular one-piece supporting base which defines home plate.

Ciccarello, U.S. Pat. No. 3,658,329, shows a swinging rigid strike zone supported by a simulated batter. The strike zone is not adjustable in size or location and there is no singular one-piece supporting base which defines home-plate of the strike zone.

Britton, U.S. Pat. No. 3,997,158, shows a strike zone target made of chains which can be suspended in front of a backstop. The size of the strike zone is not adjustable (additional chains may be added to define other zones), and there is no singular one-piece base which defines home-plate of the strike zone at ground level.

Playter, U.S. Pat. No. 4,254,952, shows a pitching practice device in the form of a sheet of canvas with a rectangular strike zone window subdivided into a number of sections. The strike zone (window) is not adjustable in size or location. There is not a singular one-piece base which defines home-plate of the strike zone at ground level.

Newland, U.S. Pat. No. 4,657,250, shows a pitching practice device having a yielding strike zone target which allows the ball to pass through the target into a photoelectric detector. The strike zone is not adjustable in size or location. There is no singular one-piece base which defines home-plate of the strike zone at ground level.

Paquet, et. al., U.S. Pat. No. 5,230,505, shows another electronic pitch analyzer which can detect the speed and location of the ball as it passes through the sensor. There is solid target zone behind the sensors which is not adjustable in size or location.

Helmetsie, U.S. Pat. No. 5,433,434, shows a pitching practice device having a support frame made of multiple members from which a strike zone is suspended by means of elastic bands. The strike zone is adjustable in height. The device has a catcher target and simulated batter. The strike zone is not adjustable in width. Them is no singular one-piece base which defines home-plate of the strike zone at ground level.

SUMMARY OF THE INVENTION

The invention presents a portable pitching training device having a singular one-piece supporting base. It supports a parallel strike zone frame which is fully adjustable in height and adjustable in width on the singular base. The base, of which, has a white colored middle section 17 inches long that represents home plate and aids in visualization of the strike zone. The strike zone frame may also be adjusted into non-parallel shapes, such as trapezoids and trapeziums, if desired to emphasize pitching techniques. The invention is also adaptable to soccer, lacrosse, archery or the like by appropriate choice of strike zone frame size, shape, and position. The singular one-piece base and supported strike zone frame provide a free-standing portable device which may be used on various surfaces such as grass, ground, gymnasium floor, cement, or asphalt.

DESCRIPTION OF THE PREFERRED EMBODIMENT

Figure 1:
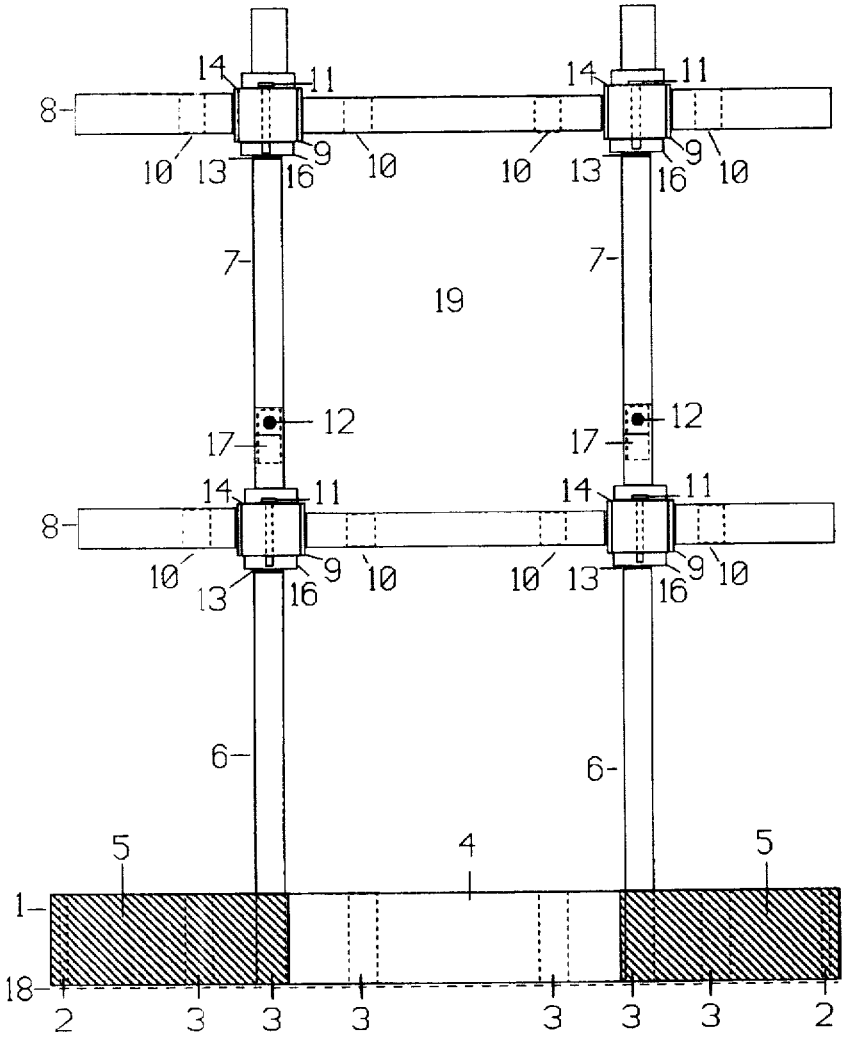
FIG. 1 shows a front view of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such as alterations and further applications of the principles, of the invention as illustrated, therein being contemplated as would normally occur to one skilled in the art to which the invention relates. In the following discussion of the figures, identical reference numbers from figure to figure refer to identical elements. Only those elements specifically needed in understanding a given figure will be mentioned in the discussion.

Figure 3:
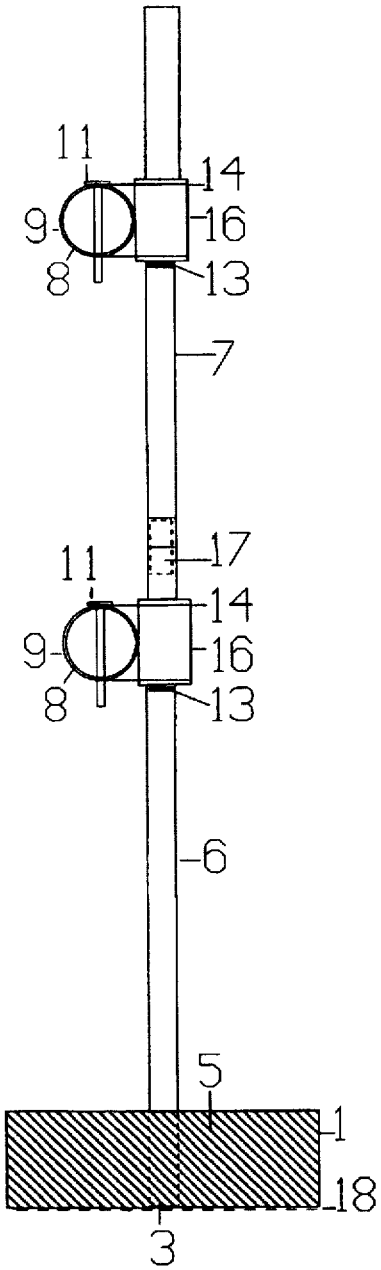
FIG. 3 shows a side view of the invention

FIGS. 1 and 3 show the preferred embodiment of the invention in front and side view, respectively. It is to be understood that for simplicity the present invention is described in terms of "baseball", it being understood that herein the term baseball includes baseball, softball, whiffle ball, soccer, archery and other such games in which a target "strike zone" may be utilized for practice purposes.

Figure 2:
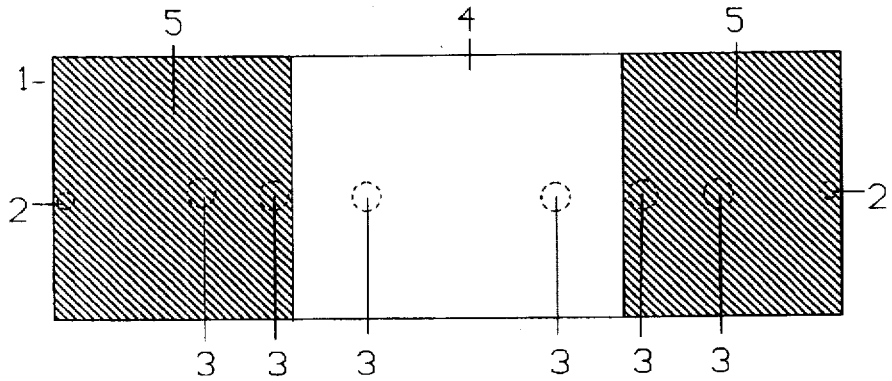
FIG. 2 shows a top view of the invention base.

The apparatus of the invention has a singular one-piece base (1) about 28 inches in length and 7¼ inches in width. The base is of sufficient weight to support lightweight flexible strike zone frame members. Wood has been found to be especially appropriate for use as a base. A hollow formed base for the addition or removal of ballast may also be used. In the preferred embodiment the base has sufficient height, about 1½ inches, to establish six apertures (3) of about ⅝ inch diameter for the insertion of the vertical upright members (6) of the strike zone frame. The base also has smaller apertures (2) located on the ends of the base for providing holes to receive stakes, nails, large eye-bolts, or appropriate anchors for providing stability when the device is used on the ground. The base has a white colored section (4) in its center for 8½ inches towards either end for a total of 17 inches, the width and color of a home plate. The white colored section of the base is an important feature because unlike other inventions it provides a visual reference of a simulated home plate at ground level, to the pitcher, within the constructs of the invention. In the preferred embodiment the ends (5) of the base, best illustrated as the shaded areas in FIG. 2, are brown in color but optionally may be any arbitrary color other than white. Preferably the device would be positioned on a baseball field over "home plate" so that the white section of the base would correspond with the home plate directly beneath. The base would then be secured with anchors inserted through the end apertures (2) and anchored to the ground. The base also has dimpled rubberized material (18) affixed to the underside to provide additional stability when the device is used on concrete, asphalt, or other surfaces where anchors are not appropriate.

Two of the six vertical-member apertures (3) in the base are centered across its width and located immediately adjacent to, and outside of, the white section (4) of the base on either side. The other four vertical-member apertures (3) are located 2½ inches to either side of the ones adjacent to the white section (4) thus two are located in the white section and two are located further towards the ends of the base. An important feature these apertures provide, unlike other inventions, is for specific and simple width adjustment of the vertical upright members. This is important because the entire width of the ball is not required to pass over the plate to be a strike. This invention allows pitcher to have a target that is the width of the plate and most of the ball. This facilitates the pitcher being able to practice "hitting the corners", or having only part of the ball pass over the plate which is usually a more desirable pitch.

The vertical members (6) and (7) and the horizontal members (8) of the strike zone frame can be made of any suitable material which will be sufficiently strong to withstand hits by errant balls, yet flexible and resilient enough to return to their original position after being struck by errant balls, and light enough to transport. Polyvinyl Chloride (PVC) pipe of approximately ½ inch has been found to be especially appropriate for this use. The ½ inch PVC pipe is wide enough and of sufficient visual contrast to be easily seen from the pitcher's position (approximately 60½ feet from home plate, for standard baseball). The vertical upright members have a lower section (6), about 28½ inches in length which is inserted into the chosen apertures (3) in the base (1), and an upper section (7), about 28½ inches in length which is affixed to the lower section to make up the entire length, about 57 inches, of the vertical upright members. The upper section (7) is affixed to the lower section (6) by a length of rod (15), about 12 inches in length. The rod must be of sufficient strength as to not break when hit by an errant ball. Metal threader rod of approximately 7/16 inch diameter has been used in the invention. Two inches of rod are inserted into the lower end of the upper section and permanently secured by a tension pin (12). The ten inches of rod extending out of the bottom of the upper section (7) is inserted into the top of the lower section (6) securing the two sections together making the complete vertical upright member. The vertical upright members having two easily assembled sections each makes them convenient to transport. Optionally, the vertical upright members may be marked with unit measurements as a means to facilitate more precise or calculated adjustments of the strike zone.

Figure 7:
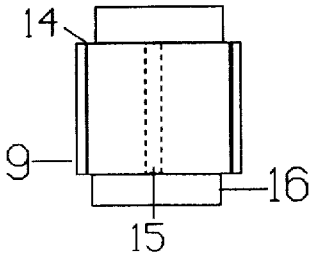
FIG. 7 shows a front view of the coupling collar used in the preferred embodiment of the invention.
Figure 6:
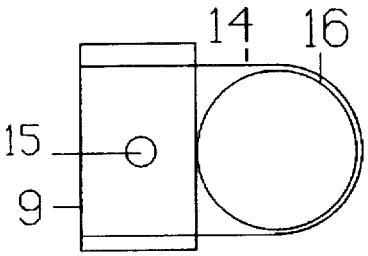
FIG. 6 shows a top view of the coupling collar used in the preferred embodiment of the invention.
Figure 5:
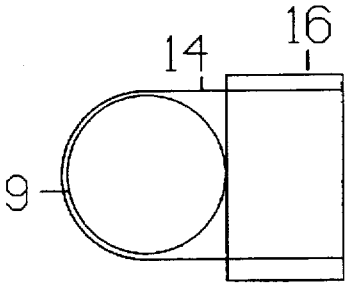
FIG. 5 shows a side view of the coupling collar used in the preferred embodiment of the invention.

The horizontal members (8) of the strike zone frame are affixed to the vertical members by means of a coupling collar (9) and (16). Detail of the coupling collar is shown from a side view FIG. 5, a top view FIG. 6, and a front view FIG. 7. The coupling collar must be strong enough to withstand hits by errant balls. Water line Polyvinyl Chloride (CPVC) pipe of approximately ¾ inch has been found to be especially appropriate for this use. The body (9) and (16) of the coupling collar is two sections of ¾ inch CPVC pipe, each approximately 1¾ inches in length, joined together in the form of a cross. The front piece of the coupling collar (9) is positioned horizontally and the rear piece (16) is positioned vertically. The front horizontal section (9) has ¼ inch holes (15) drilled through the center, from top to bottom, of the two sides of the tubing. These holes are for the purpose of receiving a stabilizing pin (11) which secures the horizontal strike zone frame member (8) to the horizontal coupling collar (9) at a specific aperture. The vertical and horizontal sections of the coupling collar are joined by means of a rubber "O" ring (14), approximately 1½ inches in diameter. The rubber "if" ring couples the two sections of the collar by being slipped over the top of the rear vertical section then stretched tightly over the front horizontal section, and finally pulled back and looped over the bottom of the rear vertical section. The "O" ring couples the two sections of the collar tightly so they won't become separated when hit by errant bails, yet permits the front horizontal section to have a swivel action due to the elasticity of the rubber "O" ring. This swivel action, of the coupling collar, is an important feature because it allows the horizontal members of the strike zone frame to be positioned into non-parallel positions without distorting the vertical upright members. This effect is best illustrated in the position of the upper horizontal strike zone frame member and coupling collars in FIG. 4.

The horizontal strike zone frame members (8) are approximately 26½ inches in length and made of ½ inch PVC pipe. The horizontal strike zone frame members have ¼ inch holes (10) drilled through the center, from top to bottom, of the two sides of the tubing. These holes are positioned along the length of horizontal frame member at points, when it is centered with the length of the base, that correspond in position with the base apertures (3) which receive the vertical frame uprights. These holes (10) are for the purpose of receiving a stabilizing pin (11) which secures the horizontal strike zone frame member (8) to the horizontal coupling collar (9) at a specific chosen aperture which will correspond to a base aperture. A plastic anchor has been used as a stabilizing pin in the invention.

Figure 4:
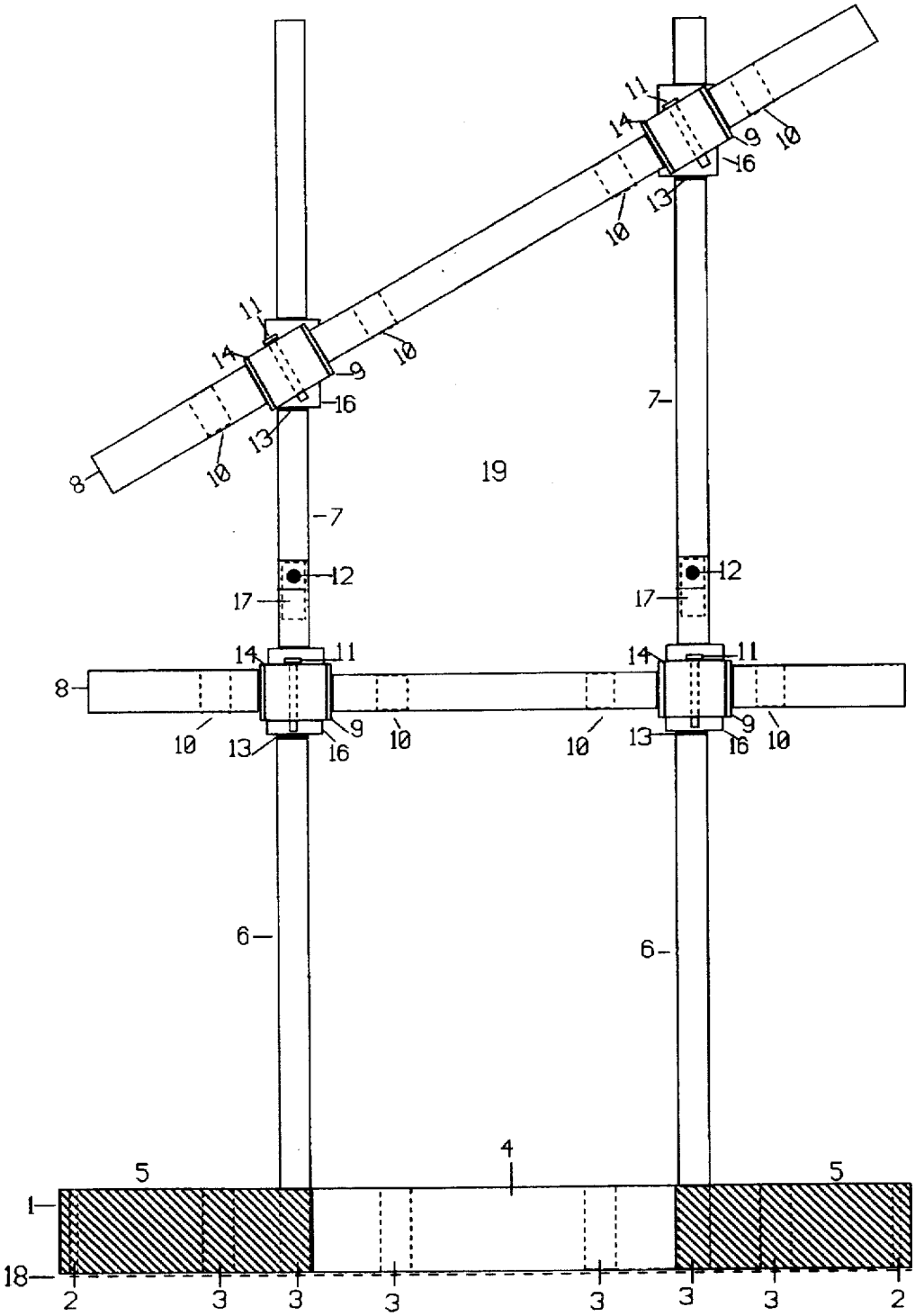
FIG. 4 shows a front view of the invention, with the strike zone adjusted to a non-parallel shape.

The vertical strike zone frame members, (6) and (7), lower and upper sections respectively are fitted with a small rubber "O" ring (13) approximately ⅜ inches in diameter. The "O" rings can be easily slid up and down the vertical frame members to make an infinite number of fine adjustments in height of their position. These "O" rings fit tightly on the vertical frame members and are for the purpose of easily positioning the horizontal frame members (8) at chosen positions of height on the vertical upright frame members (6) and (7). By sliding these "O" rings unevenly, so that one side is raised more than the other, the strike zone (19) may be positioned into a non-parallel shape as seen in FIG. 4. The parallel shape effect of sliding them to even positions on the vertical members can be seen in FIG. 1. An important feature of the invention is that the "O" rings, once slid into position are not affected by being hit by errant balls thus the horizontal frame members will retain their originally selected height at the point of the "O" ring.

The horizontal frame members (8) are affixed to the device by means of the coupling collar (9) and (16). A single rear vertical member (16) of a coupling collar is slipped over a vertical upright strike zone frame section (6) and (7) respectively. The "O" ring (13) stops the collar at a selected position. The horizontal strike zone frame members (8) are inserted into the horizontal members (9) of the coupling collars. An aperture (10) in the horizontal frame member, to select the appropriate width, is aligned with the holes (15) of the coupling collar and a pin (11) is inserted down through the aligned holes to stabilize the horizontal frame member to the vertical frame member at the chosen position of width. This can be easily adjusted by removing the pin, realigning different holes and re-inserting the pin. An important feature of the invention is that when the horizontal and vertical members are coupled at specific apertures they will remain in that position, usually parallel, and cannot be shifted by being hit by errant bails.

Unlike other devices which are comprised of a frame that supports a contrived strike zone, with this invention the frame itself creates the strike zone. In the preferred embodiment the horizontal frame members in combination with the vertical frame members form a target area defined as the "strike zone" (19) and illustrated in FIG. 1 and FIG. 4.

Accordingly, while the invention has been illustrated and described in detail in the drawings and foregoing description it is to be understood that the embodiments of the invention herein described are merely illustrative and not restrictive in character. Reference herein to details of the illustrated embodiments are not intended to limit the scope of the claims, and that all changes and modifications that come within the spirit of the application of the principles of the invention are desired to be protected.

What is claimed is:

1. A portable sports training apparatus for defining a strike zone comprising in combination:

a) a singular one-piece rectangular stabilizing support base;

b) said base being sectionalized by color into a middle and ends;

c) the middle of said base, being seventeen inches in length, eight-and-a-half inches either way of center, and colored white;

d) the ends of said base being of an arbitrary color other than whim;

e) said base having end apertures to accommodate anchors for additional stability;

f) said base having a textured rubberized bottom for additional stability and support on surfaces nonconducive to anchors;

g) said base being of a solid composition with sufficient weight to support a lightweight "strike zone" frame;

h) said base being optionally hollow for use with ballast;

i) said base having a plurality of centrally coordinated apertures to accommodate a pair of spaced vertically extending parallel frame members;

j) two vertically extending parallel upright members;

k) said vertical upright members being horizontally movable to selected centrally located apertures along the length of the supporting base to enable an adjustment of the vertical, or width, area of said strike zone;

l) said vertical frame members each separated into two halves joined in the middle by a union thereby making one length;

m) upper and lower horizontally extending frame members coupled to the upper and lower ends of said vertical frame members respectively which together frame in space a "strike zone";

n) said horizontal frame members are affixed to said vertical frame members by means of a coupling collar;

o) said coupling collar comprised in combination of a rear vertical member with a forward horizontal member in which said horizontal member has a central aperture;

p) said coupling collar rear vertical member used to affix said vertical frame member and said coupling collar forward horizontal member used to affix said horizontal frame member;

q) said horizontal frame members have uniform identically spaced apertures corresponding in relative position along their length to the spaced central apertures of the base, for securing said horizontal frame members to said horizontal coupling collar members by means of a stabilizing pin and to fix and define the width between said vertical members thereby stabilizing the position of said vertical members;

r) said horizontal frame members are vertically movable to selected positions along the length of said vertical frame members to enable adjustment of the horizontal area of the zone.

2. The base of claim 1 can be optionally situated over a home-plate with the white part of the base congruent with the home plate, otherwise it can be considered to represent a home-plate, to further define the strike zone.

3. A portable sports training apparatus for defining a strike zone comprising in combination:

a) a singular one-piece stabilizing support base having a plurality of centrally coordinated apertures to accommodate a pair of spaced vertically extending parallel frame members;

b) said vertical upright members being laterally movable to selected centrally located apertures along the length of the supporting base to enable an adjustment of the width area of said strike zone;

c) two horizontally extending members affixed to said vertical members, movable to an infinite number of selected positions along the length of said vertical frame members to enable adjustment of the height area, which frame in space a "strike zone";

d) said vertical and horizontal members which form a "strike zone" provide a fully adjustable target configuration which may be adjusted in position, size, and shape; The "strike zone" shape may be rectangular or non-rectangular.

* * * * *